US006945917B1

(12) United States Patent
Baatz

(10) Patent No.: US 6,945,917 B1
(45) Date of Patent: Sep. 20, 2005

(54) RESISTANCE EXERCISE APPARATUS AND TRAINER

(75) Inventor: Wilfried Baatz, Seattle, WA (US)

(73) Assignee: Racer-Mate, Inc., Seattle, WA (US)

( * ) Notice: Subject to any disclaimer, the term of this patent is extended or adjusted under 35 U.S.C. 154(b) by 665 days.

(21) Appl. No.: 09/718,885

(22) Filed: Nov. 21, 2000

(51) Int. Cl.[7] ..... A63B 69/16
(52) U.S. Cl. ..... 482/63; 482/57
(58) Field of Search ..... 482/51, 57–65

(56) References Cited

U.S. PATENT DOCUMENTS

| | | | | |
|---|---|---|---|---|
| 3,860,235 A | | 1/1975 | Del Mar | |
| 4,441,705 A | | 4/1984 | Brown | |
| 4,674,742 A | | 6/1987 | Baatz | |
| 4,852,872 A | * | 8/1989 | Lo | 482/59 |
| 4,898,379 A | | 2/1990 | Shiba | |
| 4,955,600 A | * | 9/1990 | Hoffenberg et al. | 482/61 |
| 4,958,831 A | * | 9/1990 | Kim | 482/65 |
| 5,031,900 A | | 7/1991 | Leask | |
| 5,042,795 A | * | 8/1991 | Bursik | 482/61 |
| 5,256,115 A | | 10/1993 | Scholder et al. | |
| RE34,479 E | | 12/1993 | Minoura | |
| 5,382,208 A | * | 1/1995 | Hu | 482/63 |
| 5,480,366 A | * | 1/1996 | Harnden et al. | 482/61 |
| 5,656,001 A | * | 8/1997 | Baatz | 482/61 |

FOREIGN PATENT DOCUMENTS

| | | |
|---|---|---|
| EP | 0 255 142 A1 | 2/1988 |

* cited by examiner

*Primary Examiner*—Gregory L. Huson
*Assistant Examiner*—Tam Nguyen
(74) *Attorney, Agent, or Firm*—Christensen O'Connor Johnson Kindness PLLC

(57) ABSTRACT

An apparatus for providing exercise to recreational users and training to professional users comprising a support frame on which a bicycle frame is mounted and a resistance generation unit coupled to the support frame to provide resistance against the pedaling of the user. The resistance unit comprises a magnetic field generation source and a flywheel having an annular ring constructed from a plurality of segments of a non-magnetic, conductive material. The resistance exercise apparatus and trainer utilizes the flywheel to eliminate the need for the conventional rear wheel of a bicycle. The use of the flywheel as part of the resistance generation unit creates a "single-stage" resistance exercise trainer, because the resistance generated on the flywheel is transmitted to the user through a direct chain drive of a conventional bicycle. According to another aspect of the present invention, the resistance exercise apparatus includes a chain tensioning mechanism. The chain tensioning mechanism provides a method of tightening or loosening the tension of the chain to improve the overall efficiency of the chain drive mechanism and prevent the chain from "jumping" off the chain ring during operation.

5 Claims, 4 Drawing Sheets

RESISTANCE EXERCISE APPARATUS AND TRAINER

FIELD OF THE INVENTION

The present invention relates generally to stationary exercise equipment, and more particularly to a cycle-type stationary exercise apparatus.

BACKGROUND OF THE INVENTION

Cycling is a very popular activity for both recreational riders and racing enthusiasts alike. Professional cyclists and triathletes are earning large sums of money through races, sponsorships, and advertisements. Moreover, cycling provides many health benefits for average riders in that it strengthens various muscle groups along with providing aerobic and anaerobic exercise to the user. Furthermore, physicians and physical therapists are turning to stationary cycle devices to rehabilitate patients from automobile, athletic, or work-related injuries. Because of this, there is a demand for indoor, stationary trainers that simulate actual outdoor riding so that professional and recreational cyclists may train or exercise regardless of the weather, and that patients can rehabilitate injuries in the presence of their physicians and physical therapists.

Various stationary cycle trainers have been presented to address this need. Conventional stationary cycle trainers simulate the characteristics of outdoor training by applying a variable resistance device to provide resistance against the pedaling of the rider. The variable resistance device mimics the resistances a rider would face during actual outdoor training such as wind resistance, rolling resistance, and resistances due to riding over varying terrain. Recently, the use of "eddy current" trainers have achieved widespread use due to their ability to simulate the resistance (loads) felt by riders during actual riding.

In one prior art "eddy current" trainer shown in FIG. 1, the trainer 10 includes an eddy current brake 12 that is coupled to the rear wheel 14 of a bicycle 16. The eddy current brake 12 includes a shaft 18 that is placed in rotational contact with the rear wheel 14 of the bicycle 16. As the rear wheel of the bicycle rotates, it rotationally drives the shaft.

The eddy current brake 12 further includes a conductive disk (not shown) that is coupled to the shaft 18 and is disposed between a plurality of electromagnets (not shown). When the rider rotates the pedals of the bicycle, the conductive disk rotates via the shaft 18 and the rear wheel 14. As the disk rotates, the electromagnet's magnetic fields induce eddy currents within the rotating disk. The eddy currents in turn produce electromagnetic fields that interact with the electromagnet's magnetic fields. This interaction of electromagnetic fields produces a resistance to the rotation of the disk, and thus the shaft 18 and rear wheel 14 of the bicycle 16.

The use of electromagnets allows individual or groups of magnets to be energized at specific times and voltages to produce variable torques, and resistances to the rotation of the bicycle's rear wheel. The use of electromagnets allows the resistance or braking force to be set to any desired level, or varied in order to duplicate actual road conditions experienced by the bicycle rider. Trainers incorporating such an eddy current brakes can take into account wind resistance, head winds, changes in elevation, rider inertia, rolling resistance, the effects of drafting, etc.

Further advancements in "eddy current" trainers allow for the monitoring and evaluation of the rider's or patient's performance during the exercise session. These trainers use a microprocessor/sensor arrangement to calculate several session perimeters such as heart rate, energy exertion, time elapsed, and distance. The microprocessor is also connected to an electric drive circuit that energizes the electromagnets at predetermined times and power levels in order to simulate changes in terrain. An eddy current trainer that uses electromagnets to simulate real life bicycling road conditions, and that uses a microprocessor to evaluate the user's performance, is sold under the trademark COMPUTRAINER by Racermate, Inc., Seattle, Wash.

Although the use of electromagnets and microprocessor has dramatically improved the "eddy current" trainers, there are still limitations that exist. For example, the arrangement of the rear wheel contacting the shaft of the resistance brake requires the user to exert a minimum power output of around 50 watts to just get the rear wheel and the conductive disk to rotate. Some rehabilitation patients cannot exert this amount of power. Additionally, the contact of the rear wheel against the shaft does not allow the user to coast. Furthermore, the friction losses due to the prior art arrangement only allows the measurement of the exercise session perimeters to be accurate within 1–2%.

SUMMARY OF THE INVENTION

The present invention addresses the limitations in the prior art by providing a stationary exercise trainer that uses a "single stage" arrangement that eliminates most of the friction loss experienced by the prior art trainers. Specifically, by eliminating essentially one stage (the resistance transfer between the shaft 18 and the rear wheel 14), the trainer can suitably operate over a broad range, such as for competition, in the range of 0–2000 watts of power. By allowing the trainer to function with approximately zero input power from the user, the trainer can be used for rehabilitating patients with minimal strength. Additionally, the reduction in friction losses allows for the measurement of the physical exertion levels of the user during the exercise sessions to be accurate to within approximately plus or minus 1%. Further, by eliminating the contact between the shaft or roller and the rear wheel in the prior art trainers, the trainer of the present invention allows the user to coast (the ability of the flywheel to rotate independently from the pedals).

In accordance with a first aspect of the present invention, the resistance exercise apparatus and trainer comprises a support frame having a front support member and a rear mounting assembly. A bicycle frame having a rotatable front fork and a rear fork is detachably coupled to the respective front support member and rear mounting assembly of the support frame. A flywheel is rotatably coupled to the rear mounting assembly of the support frame. A transmission system, including a rear sprocket coupled to the flywheel and a user operable crank assembly, is coupled to the bicycle frame. The crank assembly is operably connected to the rear sprocket through a flexible drive element. A magnetic field generation source is coupled to the rear mounting assembly of the support frame and a portion of the flywheel passes through the magnetic field source.

In accordance with a second aspect of the present invention, a chain tensioning device is provided for an exercise training apparatus having a frame and a resistance transmission including a flexible drive element. The chain tensioning device comprises a base and a support member that projects upwardly from the base which supports the flexible drive element. The first end of an elongate deflection member is secured to the support member and the second end of the deflection member is secured to the frame. A linear actuator is mounted on the support member and an end of the linear actuator is engagable with the second end of the deflection member, where the linear translation of the linear actuator causes the end of the linear actuator to engage with the deflection member so as to bend the deflection member away from the support member to selectively tension the flexible drive element.

In accordance with a third aspect of the present invention, a flywheel is provided for use in an exercise training apparatus. The flywheel comprises a circular body that includes an outer peripheral flange and a hub section. The hub section has a centrally located bore for receiving an axle and the circular body is adapted to be connected to the exercise resistance trainer through the axle. A plurality of radial segments of a non-magnetic, conductive material are removably coupled to the outer peripheral flange of the flywheel, where the flywheel is adapted to be connected to a transmission system for rotating the flywheel through a magnetic source.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
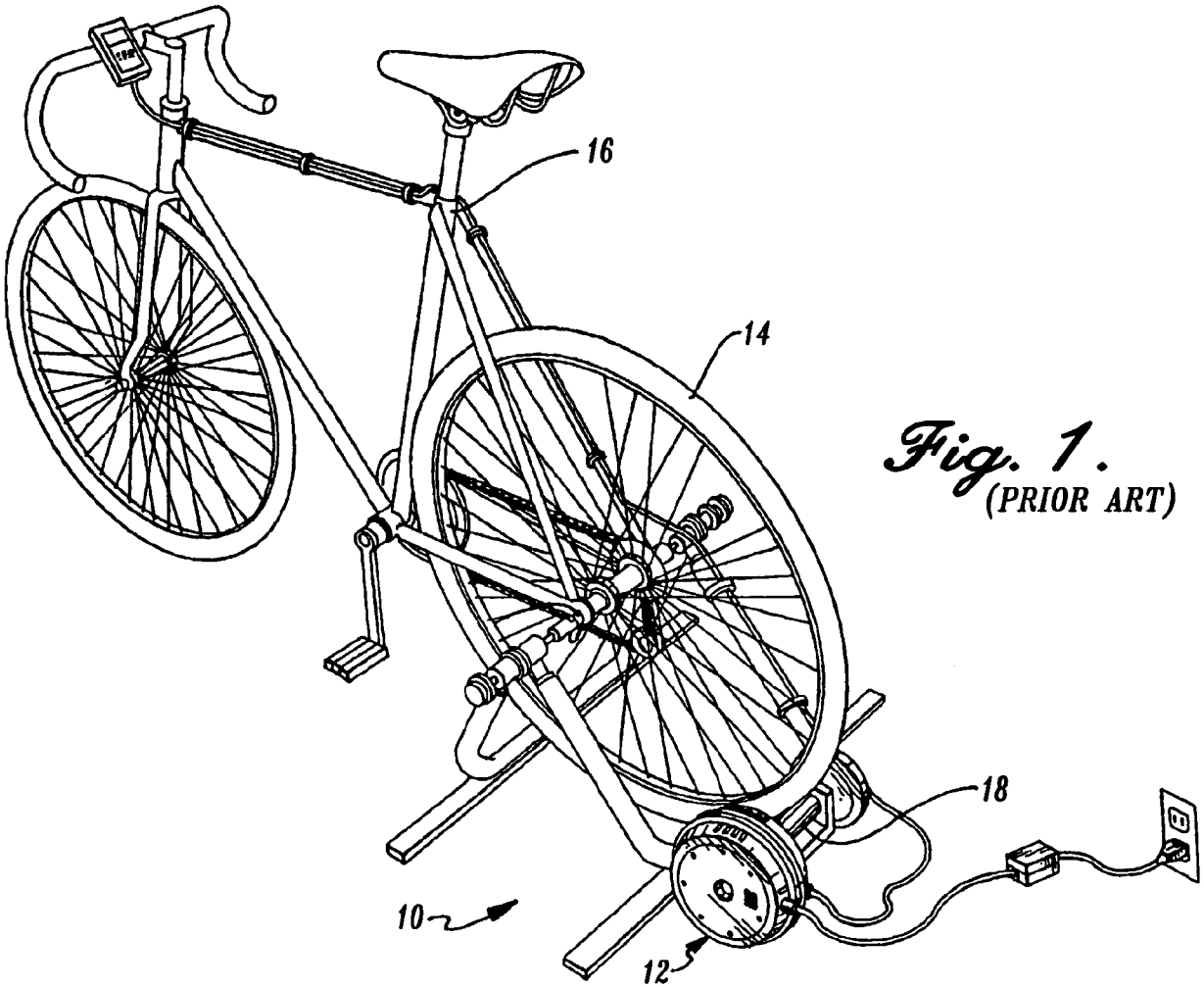
Fig. 1. (PRIOR ART)
FIG. 1 illustrates a perspective view of a bicycle mounted in a prior art eddy current exercise training apparatus.

As will be explained in further detail below, the resistance exercise apparatus and trainer of the present invention uses a "single-stage" configuration to provide a resistance against the pedaling of the user to simulate actual cycling. This is in contrast to conventional designs, as described above and as illustrated in FIG. 1, which use a "dual-stage" configuration that consists of the full size rear wheel of a bicycle coupled to a resistance or load generation unit.

The resistance exercise apparatus and trainer of the present invention comprises a support frame on which a bicycle frame is mounted, and a resistance generation unit coupled to the support frame to provide resistance against the pedaling of the user. The resistance unit comprises a magnetic field generation source and a flywheel that has the approximate dimensions of a conventional bicycle rear wheel. The resistance exercise apparatus and trainer utilizes the flywheel to eliminate the need for the conventional rear wheel of a bicycle. The use of a flywheel as part of the resistance generation unit creates a single-stage resistance exercise trainer, because the resistance generated on the flywheel is transmitted to the user through the direct chain drive of a conventional bicycle. Unlike the training devices of the prior art, the present invention provides a dramatic reduction in the amount of power needed to rotate the flywheel.

Figure 2:
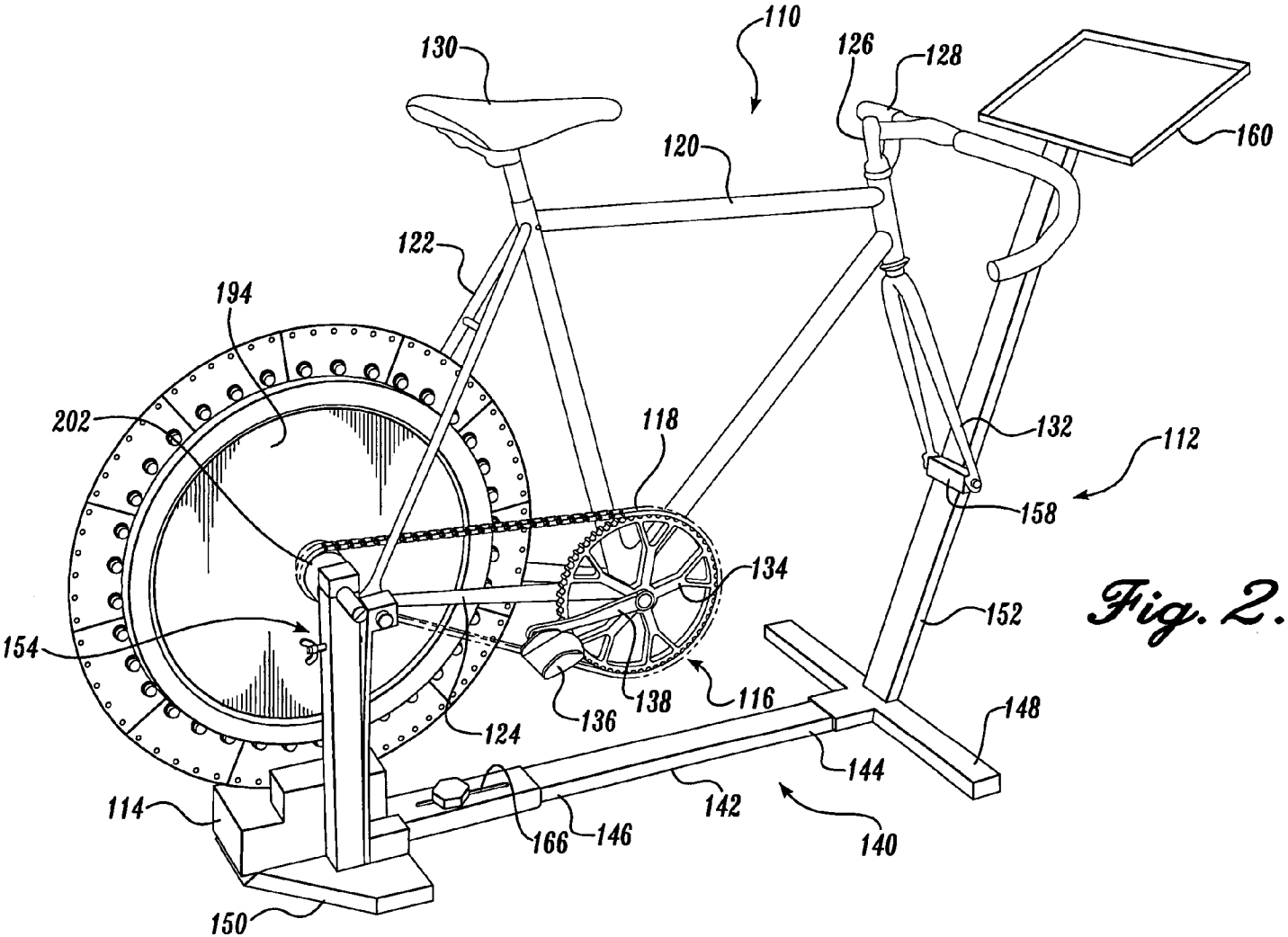
FIG. 2 illustrates a perspective view of a representative embodiment of the resistance exercise apparatus and trainer of the present invention.

FIG. 2 illustrates a bicycle 110 removably mounted to an exemplary resistance exercise apparatus and trainer 112 (hereinafter "trainer") of the present invention. The trainer 112 includes a support frame 140 for supporting the bicycle 110 in an upright position and a resistance generation unit 114 for providing a load that simulates actual cycling resistance. The resistance generation unit 114 includes a flywheel 194 mounted on an axle journaled across the lower ends of the rear forks of the bicycle 10. The flywheel 194 is rotatably coupled to a chain drive mechanism or transmission 116 of the bicycle 110 by a continuous chain 118 in a manner well known in the art. As the user pedals the bicycle 110, the flywheel 194 begins to rotate within a magnetic field generating source. The flywheel 194 induces eddy-currents therein due to the magnetic field. The eddy-currents places a load or resistance against the rotation of the flywheel 194. This resistance is transmitted from the flywheel 194 to the user through the chain so that the user is required to exert power to sustain the pedaling of the bicycle 110.

As shown in FIG. 2, the bicycle 110 is provided with a frame 120 having seat and chain stays 122, 124 that form the rear fork of the bicycle 110. The bicycle 110 further contains a stem 126, handle bars 128 connected to the frame 120 through stem 126, a saddle or seat 130, and a front fork 132. The chain drive mechanism or transmission 116 comprises a chain ring 134 rotated by pedals 136 coupled to the chain ring 134 by crank arms 138. The chain drive mechanism or transmission 116 further includes a chain 118 that couples the chain ring 134 to a rear sprocket 202 so that rotation of the of the pedals 136 is transmitted to the rear sprocket 202. The rear sprocket 202 is coupled to the flywheel 194 of the trainer and is described in more detail below. While a drive chain is illustrated in the preferred embodiment, alternate flexible drive elements could be utilized, such as a belt drive.

Referring to FIG. 2, the support frame 140 includes a longitudinally extending main frame member 142 having distal and proximal ends 144, 146, front and rear stabilizing members 148, 150 which intersect the main frame member 142 at right angles, an obliquely angled front support member 152, and a rear mounting assembly 154. The front stabilizing member 148 and the front support member 152 are secured to the distal end 144 of main frame member 142 through fasteners (not shown) such as bolts or the like. The front support member 152 includes a front fork attachment mechanism 158. The lower end of the front fork 132 of the bicycle 110 is removably coupled to the front fork attachment mechanism 158 provided at about the mid-section of the front support member 152 of support frame 140. The front fork attachment mechanism 158 further includes apertures (not shown) so that an optional display support 160 for holding reading material, a computer monitor, or other viewable medium can be secured to the top of the front support member 152.

Figure 3:
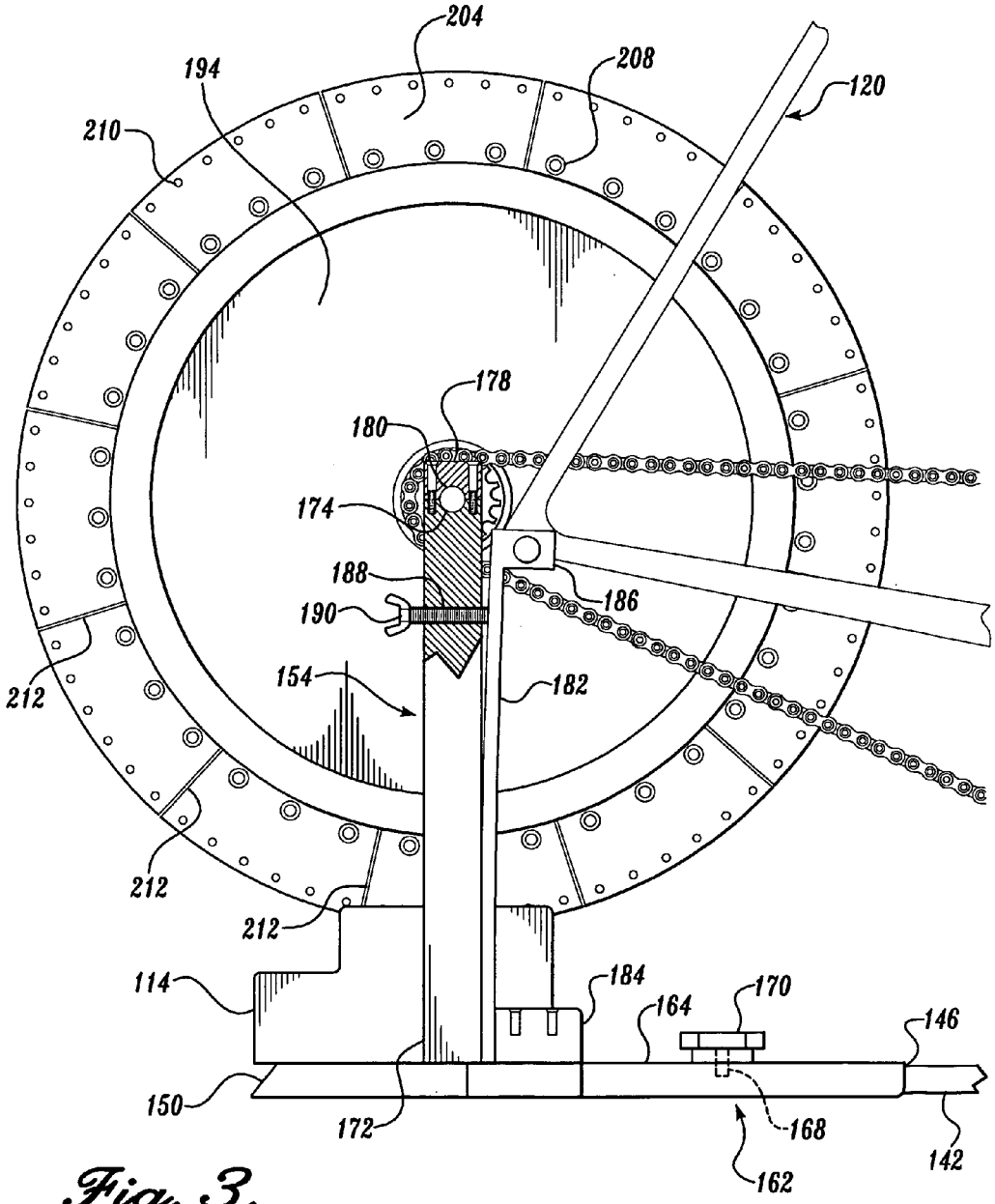
FIG. 3 illustrates an enlarged side view of a representative embodiment of the resistance exercise apparatus and trainer of the present invention.

As shown in FIGS. 2 and 3, the rear stabilizing member 150 is slideably coupled to the main frame member 142 through a frame adjustment coupler 162. The frame adjustment coupler 162 contains a flange 164 secured to the distal end of the rear stabilizing member 150 and includes a slotted portion 166 disposed on the top section thereof. The frame adjustment coupler 162 further contains a screw shaft 168 connected to the top of the proximal end 146 of the main frame member 142. The screw shaft 168 projects through the slotted portion 166 of the flange 164 and is topped by an adjustment knob 170. Loosening the adjustment knob 170 allows the rear stabilizing member 150 to freely slide over the main frame member 142 for adjustment according to the length of the wheel base of the particular bicycle to be used.

Figure 4:
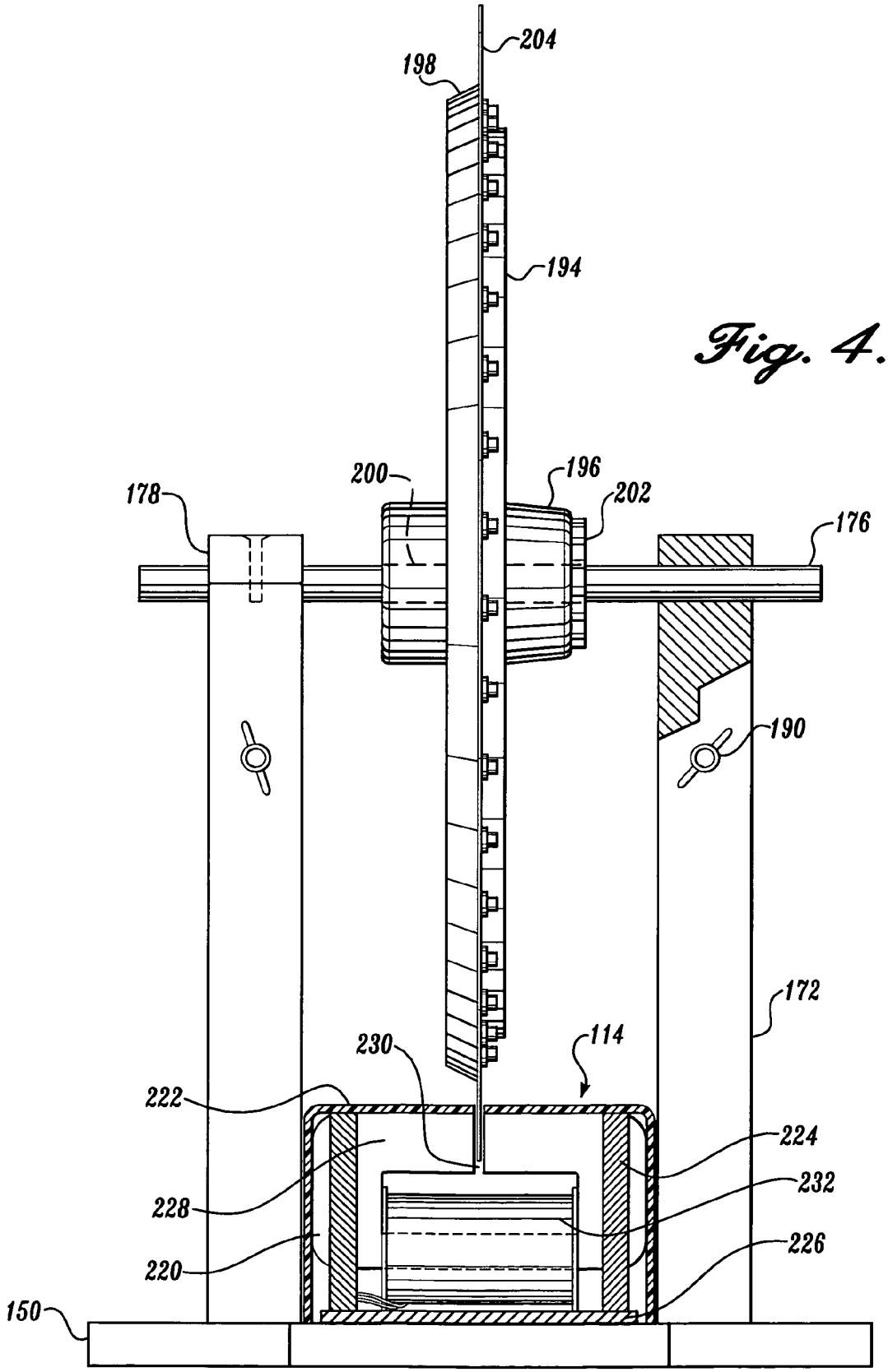
FIG. 4 illustrates a rear and partial cross-section view of a representative embodiment of the resistance exercise apparatus and trainer of the present invention.

Referring to FIGS. 2–4, a rear mounting assembly 154 is coupled to the top of the rear stabilizing member 150 for removably coupling the bicycle 110 and the flywheel 194 thereto. The rear mounting assembly 154 includes two identical spaced apart vertical members 172 secured to the top of rear stabilizing member 150. The top of each vertical member 172 includes a semi-circular channel 174 extending therethrough. A cylindrical shaft 176 is disposed within channel 174 of each vertical member 172 so that the cylindrical shaft 176 extends perpendicular to the main frame member 142. A removable cap 178 having a semi-circular channel 180 that corresponds to the channel 174 in the vertical members 172 is fastened to the top of each vertical member 172. The caps 178 removably couple the flywheel via cylindrical shaft 176 to the vertical members 172.

As best shown in FIG. 3, the rear mounting assembly 154 also includes two deflection members 182 and two anchor blocks 184. Each anchor block 184 is secured to the top of the rear stabilizing member 150 at a position spaced apart from each respective vertical member 172 such that a gap is provided therebetween. The bottom end of each deflection member 182 is inserted in the respective gap and secured to the anchor block 184 by fasteners (not shown) such as bolts and/or dowel pins so that the bottom end of the deflection member 182 is anchored at the base of the rear stabilizing member 150. The deflection member 182 extends upwardly away from the rear stabilizing member 150 to form a cantilevered member. A mounting block 186 is coupled to the front face of the top end of each deflection member 182 to provide a location from which the rear fork of the bicycle frame 120 can mount to the rear mounting assembly 154. The rear fork of the bicycle frame 120 can be fastened to the mounting block 186 in any conventional manner know in the art.

Still referring to FIG. 3, each vertical member 172 further includes a bore 188 that extends longitudinally therethrough at a location below the semi-circular channel 174. The inside surface of the bore 188 has screw threads for mating with the outside threads of a wing-headed screw 190. By turning each screw 190, the screw linearly translates through the bore due to the corresponding screw threads. The end of each screw 190 engages the back face of each deflection member 182 and bends the deflection member outwardly away from each vertical member 172 due to the cantilevered connection of each deflection member 182. The vertical member 172, the deflection member 182, and the screw 190 form a chain tensioning device, the purpose and advantages of which will be described in more detail below.

As best shown in FIG. 4, and described above, the trainer comprises a resistance generation unit 114 including a flywheel 194 rotatably coupled to the rear mounting assembly by the cylindrical shaft 176. The flywheel 194 is disposed between the chain and seat stays 124 and 122 of the bicycle 110 (FIG. 2) and includes a cylindrical hub 196 and an outer peripheral flange 198. The hub 196 includes a bore 200 of sufficient diameter to receive the cylindrical shaft 176 and extends outwardly in both directions. The rear sprocket 202 is coupled to the end of hub 196 on the side corresponding to the side of the chain ring 134 (FIG. 2). The rear sprocket 202 is coupled to the hub 196 in a manner well known in the art to provide a freewheel connection so that the flywheel 194 may rotate independently of the rear sprocket 202. As discussed above, when the user rotates the pedals 136 of chain drive mechanism 116, the chain 118 transmits the pedals' rotation to the flywheel 194 via the rear sprocket 202. See FIG. 2.

It will be appreciated to one skilled in the art that the chain tensioning device 192 provides two important functions in the present invention. First, the chain tensioning device provides an initial gap so that the chain can be easily and properly placed over the chain ring and rear sprocket. Additionally, as is known in the art, chains tend to stretch when continuous force is applied thereto and may cause the chain to "jump" off the chain ring or rear sprocket. The chain tensioning device further provides a coach or physician a method of tightening or loosening the tension of the chain to improve the overall efficiency of the chain drive mechanism and prevent the chain from "jumping" off the chain ring during operation. It will also be appreciated to one skilled in the art that the deflection member can be coupled to the vertical member through other mechanisms such as a hinge.

Referring back to FIG. 3, the flywheel 194 further includes a plurality of segments or sections 204 coupled to the outer peripheral flange 198 to form a segmented ring. The plurality of sections 204 are disposed adjacent to each other in spaced relation to provide a gap 212 therebetween. The sections 204 extend radially outward past the flange 198 and are removably coupled at the base of the flange 198 by fasteners 208 well known in the art. Slots 210 are disposed at the outer peripheral end of each section 204 so that the trainer may include an optional rotational sensor unit (not shown). The sections 204 are made of a nonmagnetic, electrically conductive metal such as copper.

It will be appreciated to one skilled in the art that using a plurality of sections to form a segmented ring in accordance with the present invention provides several benefits. The sections are made using a conventional die set by punching the desired shape from a sheet of desired material. By using several small sections instead of one continuous ring, it is more economical to make since more of the blank sheet of material can be used. Additionally, the size of the die set and punch press needed to make the sections is substantially smaller than what would be needed to make one continuous ring. This also lowers the cost of making the present invention. Further, a single section that may have warped or been damaged in some manner can be easily be replaced at minimal expense.

As shown in FIGS. 2–4, the resistance generation unit 114 further includes a magnetic field generation source 220 that is secured to the top surface of the rear stabilizing member 150 between the vertical members 172. A cover 222 is mounted over the magnetic field source 220 to protect it from dust, dirt, and debris. Inside the cover, the magnetic field source 220 includes two vertical support members 224 coupled to a base plate 226. A C-shaped member 228 having a gap 230 is coupled to each side of the vertical support members 224. A coil 232 is wrapped around each C-shaped member 228 and is connected to a source of variable current (not shown). The variable current source delivers current through the coils 232 at predetermined times and at various selected levels to produce magnetic fields between the gaps 230. The structure and operation of the electromagnet and variable current source are well know to those of ordinary skill in the art, therefor it is readily understood how to construct the electromagnet and variable current source.

It will be appreciated to one skilled in the art that coil-type electromagnets are only illustrative of the present invention and that other sources of magnetic fields such as other electromagnets or permanent magnets may be used.

The function of the trainer constructed in accordance with the above description will now be explained with reference to FIGS. 1–4. As the user pedals, the flywheel 194 rotates within the magnetic fields produced by the magnetic field source 220 due to the chain drive mechanism 116. The flywheel 194, due to the non-magnetic conductive segmented ring, induces eddy currents, and thus electromagnetic fields, within the flywheel 194 as it rotates. The interaction between the electromagnetic fields produced by the eddy currents in the flywheel and the magnetic fields produced by the magnetic field source 220 creates a torque/resistance to the rotation of the flywheel 194, and thus against the pedaling of the user. The torque/resistance produced by the resistance generation unit may be increased or decreased in order to simulate changes in terrain.

As will be readily appreciated by those skilled in the art and others, the trainer constructed and operated in accordance with the present invention has a number of advantages. First, by providing a "single stage" resistance stage, wherein the drive chain is directly coupled to the flywheel, that eliminates most of the friction loss experienced by the prior art trainers, the trainer can operate in the range of 0–2000 watts of power. In particular, by allowing the trainer to function with approximately zero input power from the user, the trainer can be used for rehabilitating patients with minimal strength. Additionally, the reduction in friction losses allows for the measurement of the physical exertion levels of the user to be accurate to within approximately 1%. Further, by eliminating the contact between the shaft or roller and the rear wheel in the prior art trainers, the trainer of the present invention allows the user to coast (the ability of the flywheel to rotate independently from the pedals).

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An exercise apparatus comprising;

a support frame including a rear mounting assembly; and a resistance unit including a magnetic field generation source and a flywheel, wherein the flywheel comprises:

a circular body including an outer peripheral flange and a hub section, the hub section having a centrally located bore for receiving an axle, the circular body rotatably connected to the rear mounting assembly through the axle;

a plurality of radial segments of a non-magnetic, conductive material are removably coupled to the outer peripheral flange defining gaps therebetween; and a driven member connected to the hub section, wherein the driven member is adapted to be drivenly connectable to a transmission system for rotating a portion of the radial segments through the magnetic field generation source resulting in a resistance against the rotation of the flywheel.

2. An exercise training apparatus comprising:

a support frame for supporting a portion of a bicycle frame; and a resistance generation unit coupled to the support fame;

wherein the support frame includes a tensioning device, the tensioning device including, a support member projecting upwardly from the support frame, an elongate deflection member having a first end secured to the support member and a second end securable to a bicycle frame, and a linear actuator mounted on the support member, an end of the linear actuator engageable with the second end of the deflection member.

3. An exercise training apparatus comprising:

a support frame having a bicycle frame mounting structure and a flywheel mounting structure;

a bicycle frame having rear fork members detachably coupled to the bicycle frame mounting structure of the support frame about a common first axis;

a flywheel rotatably coupled about a second axis to the flywheel mounting structure of the support frame in-between the rear fork members of the bicycle frame, wherein the second axis is different from the first axis;

a transmission including a driven member coupled to the flywheel and a user operable drive assembly, the drive assembly coupled to the bicycle frame and operably connected to the driven member through a flexible transmission element; and a resistance generation unit for creating resistance against flywheel rotation;

wherein the support frame includes a tensioning device for selectively tensioning the flexible drive element by adjusting the distance between the first and second axes.

4. An exercise training apparatus comprising:

a support frame having a rear mounting assembly;

a bicycle frame having rear fork members, the rear fork members being capable of detachably mounting a ground engaging wheel thereon, the rear fork members being detachably coupled to the rear mounting assembly of the support frame about a common first axis;

a flywheel rotatably coupled about a second axis to the rear mounting assembly of the support frame in-between the rear fork members of the bicycle frame, wherein the second axis is different from the first axis;

a transmission system including a driven member coupled to the flywheel and a user operable drive assembly, the drive assembly coupled to the bicycle frame and operably connected to the driven member through a flexible transmission element; and a magnetic field generation source coupled to the rear mounting assembly of the support frame, a portion of the flywheel passing through the magnetic field generation source.

5. An exercise training apparatus comprising:

a support frame having a rear mounting assembly including a first support member, and a second support member configured for selectively connecting rear fork members of a bicycle frame along a common, first connection axis;

a flywheel rotatably coupled about a second axis to the first support member of the rear mounting assembly in-between the rear fork members of the bicycle frame, wherein the second axis is different from the first connection axis; and a magnetic field generation source coupled to the rear mounting assembly of the support frame, a portion of the flywheel passing through the magnetic field generation source.

* * * * *